US011452367B1

(12) United States Patent
Frankel et al.

(10) Patent No.: US 11,452,367 B1
(45) Date of Patent: Sep. 27, 2022

(54) FOLDING TABLE AND FOLDING TABLE WITH SUNSHADE COMBINATION

(71) Applicant: Zenithen USA LLC, Upland, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 0 days.

(21) Appl. No.: 17/356,715

(22) Filed: Jun. 24, 2021

(51) Int. Cl.

| | |
|---|---|
| ***A47B 3/00*** | (2006.01) |
| ***A47B 37/04*** | (2006.01) |
| ***A47B 3/08*** | (2006.01) |
| ***A47B 3/083*** | (2006.01) |
| ***A45B 17/00*** | (2006.01) |
| ***A47B 13/10*** | (2006.01) |

(52) U.S. Cl.
CPC ..... *A47B 3/002* (2013.01); *A45B 17/00* (2013.01); *A47B 3/083* (2013.01); *A47B 3/0818* (2013.01); *A47B 13/10* (2013.01); *A47B 37/04* (2013.01); *A45B 2200/1063* (2013.01); *A47B 2003/004* (2013.01); *A47B 2200/0036* (2013.01); *A47B 2220/0008* (2013.01)

(58) Field of Classification Search
CPC . A47B 3/002; A47B 3/0818; A47B 2003/004; A47B 37/04; A45B 17/00; A45B 2200/0063
See application file for complete search history.

(56) References Cited

U.S. PATENT DOCUMENTS

| | | | | |
|---|---|---|---|---|
| 2,785,735 | A * | 3/1957 | Banks | A47C 9/105 248/435 |
| 10,426,234 | B1 * | 10/2019 | Volin | A45B 25/02 |
| 10,905,231 | B1 * | 2/2021 | Horowitz | A47B 91/02 |
| 2004/0139892 | A1 * | 7/2004 | Giegerich | A47B 3/002 108/26 |
| 2005/0199162 | A1 * | 9/2005 | Hendricks | A47B 13/088 108/118 |
| 2008/0152462 | A1 * | 6/2008 | Chen | A47B 37/04 411/433 |
| 2015/0320195 | A1 * | 11/2015 | Baoqing | A47B 3/02 108/118 |
| 2020/0275770 | A1 * | 9/2020 | Frankel | A47B 3/06 |
| 2021/0401165 | A1 * | 12/2021 | Zhenni | A47B 13/16 |

FOREIGN PATENT DOCUMENTS

| | | | | |
|---|---|---|---|---|
| GB | 2558617 | A * | 7/2018 | A47B 13/023 |

* cited by examiner

*Primary Examiner* — Daniel J Rohrhoff
(74) *Attorney, Agent, or Firm* — Merek, Blackmon & Voorhees, LLC

(57) ABSTRACT

A folding table, the supporting part of which includes an upper connecting plate, a lower connecting plate, a tabletop support rod, a connecting rod and a ground support rod. One end of the tabletop support rod used to support the tabletop fabric and is hinged on the lower connecting plate, and the connecting rod is associated with the tabletop support rod and the upper connecting plate, and a shaft rod is arranged between the upper and lower connecting plates. The ground support rod passes through a slide bushing positioned on the tabletop support rod, and the upper end is hinged on the upper connecting plate or the connecting rod. The support rod of the tabletop opens to support the whole structure.

7 Claims, 6 Drawing Sheets

FOLDING TABLE AND FOLDING TABLE WITH SUNSHADE COMBINATION

BACKGROUND OF THE INVENTION

Field of the Invention

The invention belongs to the field of daily necessities, and particularly relates to a type of folding table and folding table with sunshade combination, which is especially suitable for outdoor leisure usage and work.

Technical Background

Sunshades and tables are commonly used outdoors, especially in the summer. Most self-driving travelers choose a foldable sunshade and table combination, which is convenient to store in the trunk and easy to carry for outdoor use. The sunshade technology is very mature, but most of the solutions that provide oblique sunshade have structures that are complicated or unreliable.

Chinese patent application CN200820000301.4 discloses a golf bag sunshade, which mainly utilizes a middle bar outer tube that can be inserted into the golf bag, a middle bar inner tube that can be expanded and contracted in the middle bar outer tube, and a parasol body located at the upper part of the middle bar inner tube. It has the following characteristics. The inner tube of the middle bar has a bending section that can be bent at any angle. The section also includes a waist-shaped elastic element with a large caliber part at the upper and lower ends and a small caliber part in the middle. This is a spring formed of bent elastic material. Because of the small caliber part of the waist-shaped elastic element, the sunshade can be bent at any angle through the operation of the waist-shaped elastic element in the bending section. However, it has a restoring force, which requires other components to restrain it.

Another example is U.S. patent pre grant publication No. 201720769472.2, which discloses a multi-functional sunshade which includes the sunshade rod, the sunshade frame installed on the rod and the textile attached on the outer surface of the sunshade frame. A connecting seat is fixed on the rod, and at least two pivotal grooves are installed on the connecting seat. The bottom of each pivotal groove is provided with a stopper, and each pivotal groove is matched by a supporting rod to which a table surface is attached. Furthermore, the upper sunshade rod includes two upper and lower folding rods that cooperate with each other. A U-shaped groove and a protrusion are provided between the upper and lower folding rods, and a U-shaped groove and a protrusion are provided between the U-shaped groove and the protrusion. There is at least one limiting, inclined surface, and the U-shaped groove, the convex block and the limiting inclined surface form the sunshade surface angle adjustment mechanism. The use of the conflict formed by the inclined surface and the convex block also requires other components to be constrained. If not, the wind resistance would be poor, and the angle would likely be changed by the wind.

The closest invention is also an application of the applicant, as shown in Chinese patent application CN201920261426.0, which discloses a folding table. This includes an upper support section for supporting the surface fabric and a lower support section for grounding. An upper support section is inserted into a guide tube of the lower support section by means of a shaft rod, and a support for the upper support section is formed at the bottom of the guide tube. Moreover, the upward extended shaft rod can also be used to insert a sunshade for expanded outdoor use with easy assembly. But there are also some shortcomings. For example, the folding table is composed of upper and lower parts, which can be disassembled to reduce the height after folding, but it is bulky. Second, the matching sunshade is centered and upright and cannot be adjusted according to the sun's irradiance angle.

Determining how to improve upon the inefficiencies of the current technology is the focus of this research and invention.

SUMMARY OF THE INVENTION

A purpose of the present invention is to provide a folding table with a support rod connected with a ground support rod. This can realize synchronous opening and folding operations, and the associated folding table combination with sunshade can not only provide a position for inserting the sunshade, but can also adjust the sunshade angle.

The technical plan of this invention was completed in one ore more of the following manners:

A folding table including: a fabric tabletop and a support section for supporting the tabletop.

The supporting part includes an upper connecting plate, a lower connecting plate, a tabletop support rod, a connecting rod and a shaft rod.

One end of the supporting rods is articulated on the lower connecting plate, and the other end is used to support the tabletop fabric.

The corresponding number of upper connecting rods are articulated at one end on the tabletop supporting rod, and at the other end on the upper connecting plate.

One end of the shaft rod is locked on the lower connecting plate or the upper connecting plate. The other end penetrates the upper connecting plate or the lower connecting plate. A locking kit is provided at the upper connecting plate or the lower connecting plate of the penetrating end. The shaft rod forms a restraint relationship between the upper and lower connecting plates, and the positioning is formed by the locking kit.

The upper connecting plate and the lower connecting plate move towards each other, and the tabletop support rod is in an open state to support the tabletop.

The invention also has the following special features:

It also includes several ground support rods. The ground support rod passes through a slide bushing positioned on the tabletop support rod. The upper end is hinged on the upper connecting plate or connecting rod. As the tabletop support rod is opened, the ground support rod can slide along the slide bushing to open outward. Several ground support rods are evenly distributed on the circumference with the shaft as the center of the circle, thus supporting the whole structure.

Furthermore, there are three to six ground support rods, and the number of corresponding tabletop support rods and connecting rods is a multiple of or equal to the number of ground support rods. The upper ends of the ground support rods are hinged on the connecting rod.

A folding table with sunshade combination, including a sunshade and the folding table. The sunshade has a pole, a frame and a sunshade surface. The sunshade frame is supported by the sunshade pole, and the sunshade surface is opened by the sunshade frame. In the support section of the folding table, the lower end of the shaft rod is locked onto the lower connecting plate. The upper end passes through the upper connecting plate, and the upper end is provided with an upper inclined section. The corresponding locking kit is arranged on the upper connecting plate. The lower end of the pole of the sunshade is provided with a lower inclined section, the angle between the lower inclined section and upper inclined section and the respective centerline is equal. The sunshade rod and the shaft rod are connected by the upper inclined section and lower inclined section. This is so that the sunshade pole can be adjusted in the range of twice the included angle from the vertical to the tilt. A locking mechanism is also provided at the connecting joint of the sunshade pole and the shaft rod to lock the inclination angle of the sunshade pole.

The caliber of the shaft rod is larger than that of the sunshade pole. The two connect by inserting the end of the sunshade pole into the shaft, and the locking mechanism is locked on one side of the shaft. The locking mechanism includes a sheath and a handle with a cam located on the sheath. The sheath is nested on the side of the shaft with a large caliber, and the cam portion of the handle can abut on the side of the sunshade pole with a small caliber to form a locking structure between the two parts.

The upper end of the shaft rod is equipped with a centering rod, and the upper inclined section is arranged on the centering rod. The centering rod has a lower straight section, a curved section and an upper inclined section. The upper inclined section of the centering rod and the lower inclined section of the sunshade pole forms a connecting joint. The lower straight section connects with the upper end of the shaft rod, and a locking mechanism is arranged at the connecting positions. The orientation of the sunshade pole can be adjusted by the locking mechanism at the lower straight section.

Further, the shaft rod and the sunshade pole have similar calibers which are smaller than the caliber of the centering rod. The ends of the shaft rod and the sunshade pole are inserted into the centering rod when they are connected, and the locking mechanism is locked on one side of the centering rod. The locking mechanism includes a sheath and a handle with a cam located on the sheath. The sheath is nested on the side of the centering shaft with a large caliber, and the cam portion of the handle can abut on the side of the sunshade pole with a small caliber to form a locking structure between the two parts.

The invention cleverly arranges a linked ground support rod between the tabletop support rod and the upper connecting plate or connecting rod to form a support for the whole structure. The upper and lower connecting plates are guided by the shaft rod to make the opening and folding operations more convenient and smoother. Once opened in place, it can coordinate with the locking kit to position and tighten the fabric tabletop. The use of the centrally set shaft rod provides the position of the sunshade insertion and assists the coordination of the upper and lower inclined sections to realize the adjustment of the sunshade angle. This blocks sunlight that comes from an angle, thereby extending the effective shading time/range to meet the needs of different occasions.

BRIEF DESCRIPTION OF THE DRAWINGS

Similar reference characters denote corresponding features consistently throughout the attached drawings. Namely, in the drawings the following reference numbers refer to the following part.

Figure 1:
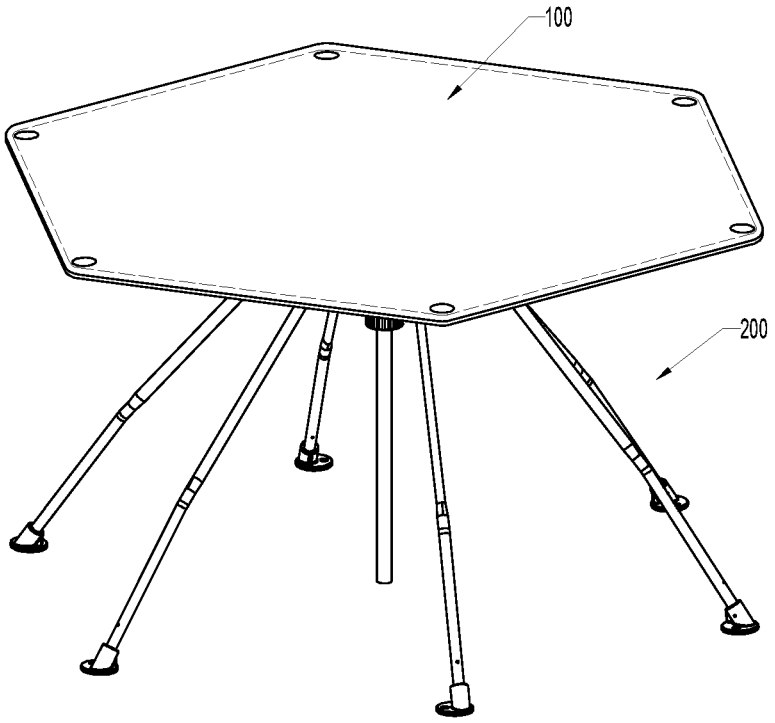
FIG. 1 shows a schematic diagram of the folding table.

| | |
|---|---|
| 100 - Tabletop | 7 - Locking kit |
| 200 - Support Section | 71 - Nut sleeve |
| 1 - Upper connection plate | 72 - Manual-adjusting bolt |
| 2 - Lower connection plate | 8 - Locking mechanism |
| 3 - Shaft rod | 81 - Sheath |
| 31 - Upper inclined section | 82 - Handle |
| 32 - Centering rod | 83 - Cam |
| 321 - Lowe straight section | 300 - Sunshade |
| 322 - Curved section | 301 - Sunshade pole |
| 4 - Tabletop support rod | 302 - Sunshade frame |
| 41 - Slide bushing | 303 - Lower inclined section |
| 5 - Connecting rod | X - Angle |
| 6 - Ground support rod | |

DETAILED DESCRIPTION OF THE PREFERRED EMBODIMENT(S)

Example 1: Folding Table

Referring to FIGS. 1 to 4, a folding table is shown that includes two main parts: a tabletop 100 made of fabric and a support section 200 that supports the tabletop. The support section 200 includes: an upper connecting plate 1, a lower connecting plate 2, a shaft rod 3, tabletop support rods 4, connecting rods 5, and ground support rod 6. One end of several tabletop support rods 4 is hinged on the lower connecting plate, and the other end is used to support the tabletop 100. One end of the corresponding number of connecting rods 5 is hinged on the tabletop support rods 4, and the other end is hinged on the upper connecting plate 1.

There are several ground support rods 6, generally three to six are better, and the number of tabletop support rods 4 and connecting rods 5 is a multiple of or equal to the number of ground support rods 6, which means that the tabletop 100 needs to have enough support. Four tabletop support rods 4 can support a quadrilateral tabletop, and eight can support an octagonal tabletop. Obviously, the more the support, the flatter the tabletop. The ground support rods 6 are considered to be able to firmly support themselves on the ground. Three rods are the minimum, and the more rods the better the stability. For example, for the octagonal table top 100, four or eight ground support rods 6 can be chosen. If four ground support rods 6 are used, a tabletop support rod 4 will be required with a ground support rod 6. The tabletop support rod 4 and the ground support rod 6 are evenly distributed on the circumference of the upper plate and the connecting plate to achieve a balanced support effect. As for the folding table with an odd number of tabletop support rods 4, it needs to be supported by the same number of ground support rods 6.

Figure 4:
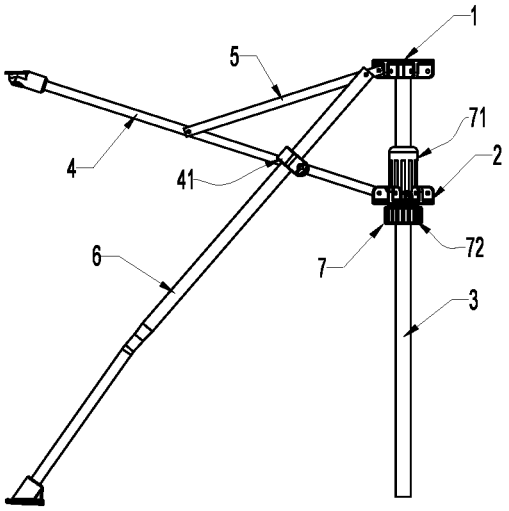
FIG. 4 shows a schematic diagram of a single piece of support relationship.
Figure 5:
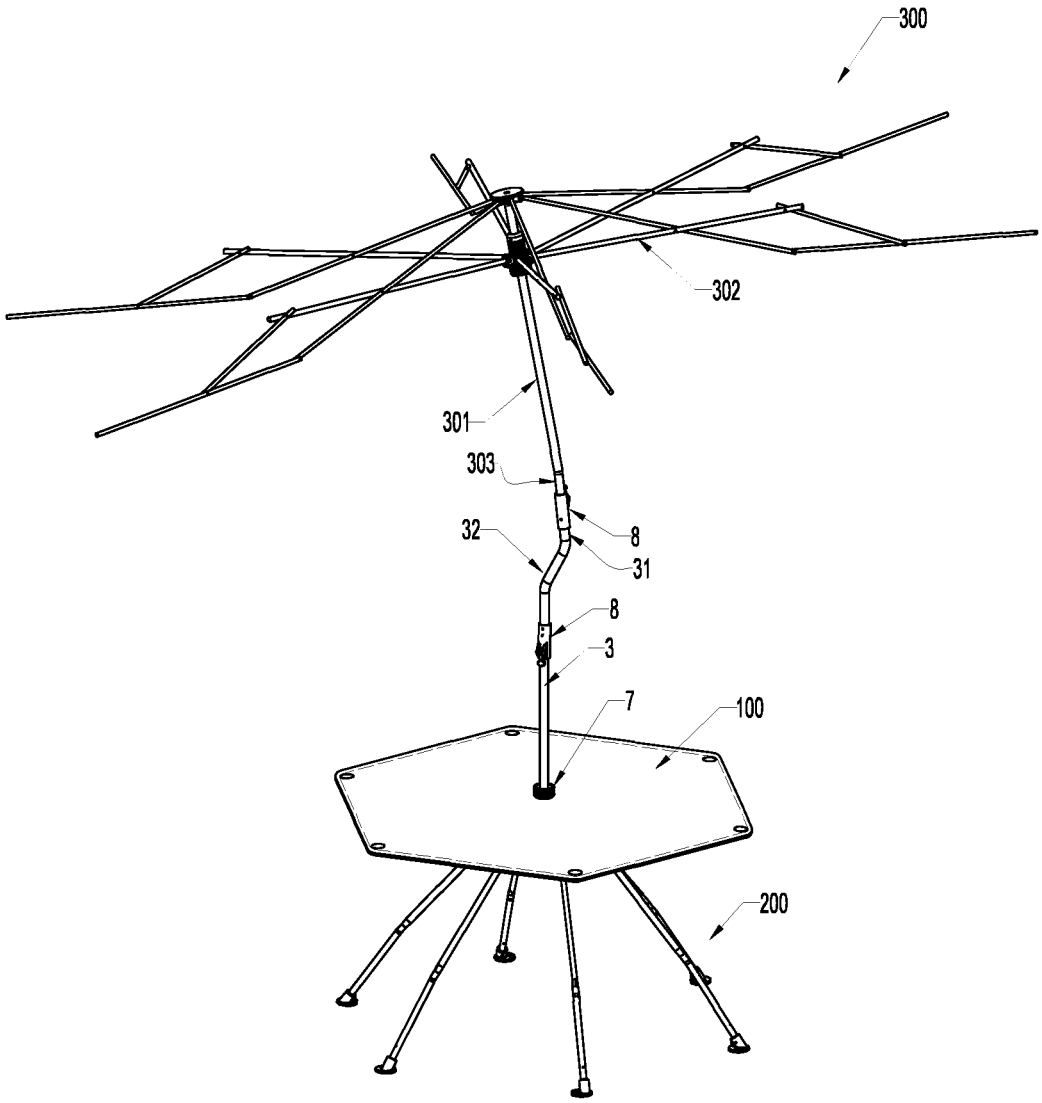
FIG. 5 shows a schematic diagram of the folding table with sunshade combination.

The ground support rod 6 passes through a slide bushing 41 positioned on the tabletop support rod, and the upper end is hinged on the upper connecting plate 1 or the connecting rod 5, as shown in FIG. 4. In this example, the upper end of the ground support rod 6 is hinged on the connecting rod 5. It can provide the space occupied by directly hinging on the upper connecting plate 1. In other words, the connecting rod 5 has a small caliber, which saves more space. With this, enough connecting rods can be distributed on the circumference of the upper connecting plate 1 with a smaller caliber to satisfy the need to support the tabletop 100. In addition, the upper end of the ground support rod 5 is hinged on the connecting rod 5, which can also adjust to a more reasonable angle and height of the ground support. As the tabletop support rod 4 opens, the ground support rod 6 can slide along the slide bushing 41 to open outward. Several ground support rods 6 are evenly distributed on the circumference centered on the shaft rod 3 to support the whole structure.

Figure 3:
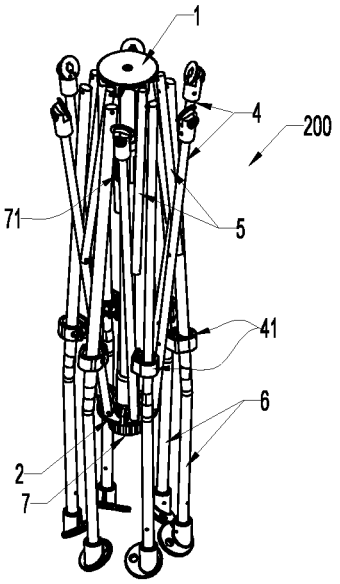
FIG. 3 shows a schematic diagram of the support section of the folding table in a folded state.

The shaft rod 3 plays the role of guiding and restraining, while also providing a positioning basis. One end of the shaft rod 3 is locked on the upper connecting plate 1, the other end penetrates the lower connecting plate 2, and a locking kit 7 is provided on the lower connecting plate 2 at the penetrating end. The shaft rod 3 constitutes the constraint relationship between the upper and lower connecting plates 1 and 2 and is positioned by the locking kit 7. The locking kit 7 involved can be the prior art shown in the CN201920261426.0 patent. It includes a nut sleeve 71 fixed at the design position of the shaft rode 3 and a hollow hand-adjusting bolt 72. The manual-adjusting bolt 72 is rotated and positioned on the lower connecting plate 2. The manual-adjusting bolt 72 can be screwed into the nut sleeve 71. The distance between the upper and lower connecting plates 1 and 2 is gradually shortened, and the tabletop 100 is gradually tightened. Reverse this operation until the manual-adjusting bolt 72 is disengaged with the nut sleeve 71. The lower connecting plate 2 descends to the limit, and forms the folded state as shown in FIG. 3.

Figure 2:
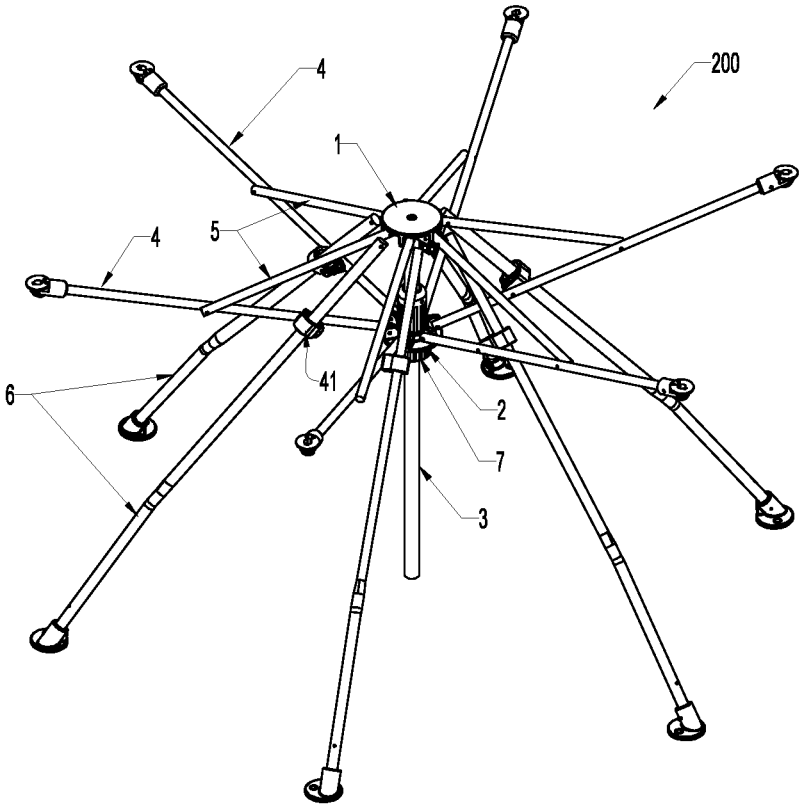
FIG. 2 shows a schematic diagram of the support section of the folding table.

In other words, the upper connecting plate 1 and the lower connecting plate 2 move towards each other, and the tabletop support rod 4 is in an open state to support the tabletop, as shown in FIG. 2. The upper connecting plate 1 and the lower connecting plate 2 move against each other, and the tabletop support rod 4 is in a folded state. As a single-function table, the upper connecting plate 1 can also support the center of the flexible fabric tabletop 100 without being prominent on the table top.

Example 1: Folding Table with Sunshade Combination

Referring to FIGS. 5 to 9, a further embodiment of a folding table is shown with sunshade combination, including a sunshade 300 and the folding table in the first example. The sunshade 300 has a sunshade pole 301, a sunshade frame 302 and a sunshade surface. Because the sunshade surface is not involved in this description, it is omitted in the figure for clarity. The sunshade pole 301 supports the sunshade frame 302, and the sunshade frame 302 supports the sunshade surface to open and close. The sunshade 300 itself is a conventional technology, but the key lies in the matching structure of the sunshade and the folding table. For this reason, the support section 200 of the folding table needs to be adjusted appropriately. When opened, the shaft rod 3 extends upwardly to receive the sunshade pole 301. The specific structure is as follows.

Figure 6:
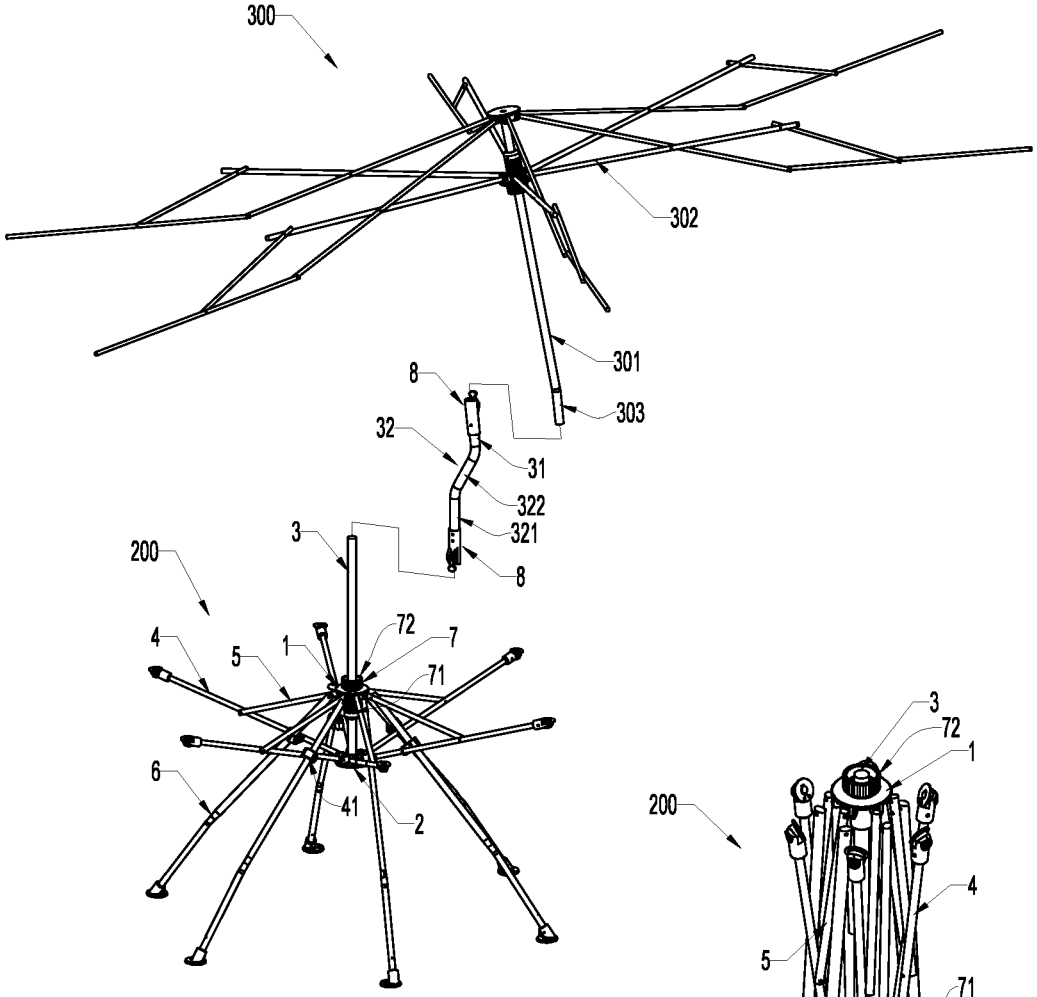
FIG. 6 shows a schematic diagram of the folding table with sunshade broken down into components.
Figure 7:
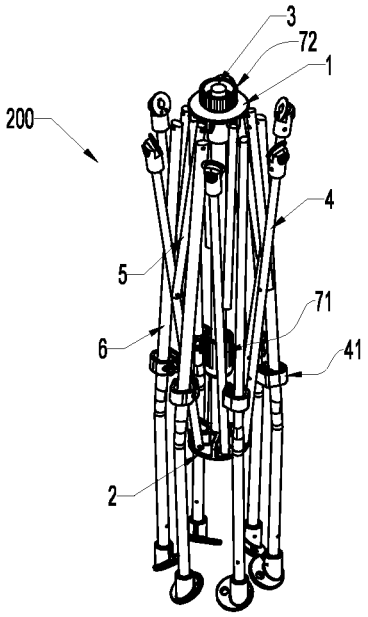
FIG. 7 shows a schematic diagram of two support sections of the folding table.

In the support part 200 of the folding table, the lower end of the shaft rod 3 is locked on the lower connecting plate 2. The upper end passes through the upper connecting plate 1, and the upper end is provided with an upper inclined section 31, while the corresponding locking kit 7 is arranged on the upper connecting plate 1, as shown in FIG. 6 and FIG. 7.

The lower end of the sunshade pole 301 of the sunshade is provided with a lower inclined section 303. The lower inclined section 303 and the upper inclined section 31 have the same angle X with the respective center lines. The sunshade pole 301 and the shaft rod 3 are inclined downward by means of the upper inclined section 31 jointing with the lower inclined section 303. This enables the sunshade pole 301 to be adjusted in the range from being upright to tilting twice the included angle X. A locking mechanism 8 is also provided at the connecting joint of the sunshade pole 301 and the shaft rod 3 to lock the inclination angle of the sunshade pole 301 based on the angle of sunlight.

In order to reduce the shearing force of the locking mechanism 8, the shaft rod 3 and the sunshade pole 301 adopt a large and small tube matching structure. The caliber of the shaft rod 3 is larger than that of the sunshade pole 301. The ends of the two connecting sunshade poles 301 insert into the shaft rod 3. The locking mechanism 8 is locked on one side of the shaft 3, that is, it is chosen to be locked on the side of the rod with a large caliber, and it is locked against the rod with a small caliber. The ends of the rods are inserted into each other to form a staggered nest, making full use of the strength advantages of the rod material itself to bear most of the shearing force generated by the connecting joint, as shown in FIG. 8 and FIG. 9.

The locking mechanism 8 includes a sheath 81 and a handle 82 with a cam part located on the sheath. The sheath 81 is nested on the side of the shaft rod 3 with a large caliber, and the cam portion 83 of the handle 82 can rest on one side of the smaller caliber sunshade pole 301 to form a locking structure between the two. During operation, only one hand is needed to swing the handle 82, which is simple and easy. The other hand is used to hold the sunshade pole 301 and adjust the rotation. Furthermore, the rivet of the locking sheath 81 happens to be used as a limit for inserting the rod, as shown in FIG. 9, thus achieving two goals.

Once the angle of the sunshade 300 is adjusted, the center of gravity of the sunshade will also shift. This results in the instability of the folding table. For this reason, a centering rod 32 is arranged at the upper end of the shaft rod 3 to adjust the center of gravity of the sunshade 300 so that it remains in the central area of the folding table. The centering rod 32 can actually be bent directly from the shaft rod 3. However, it would affect the height of the folding table after being folded, so the separation is more reasonable, and it can bring the benefits of adjusting the position.

Figure 8:
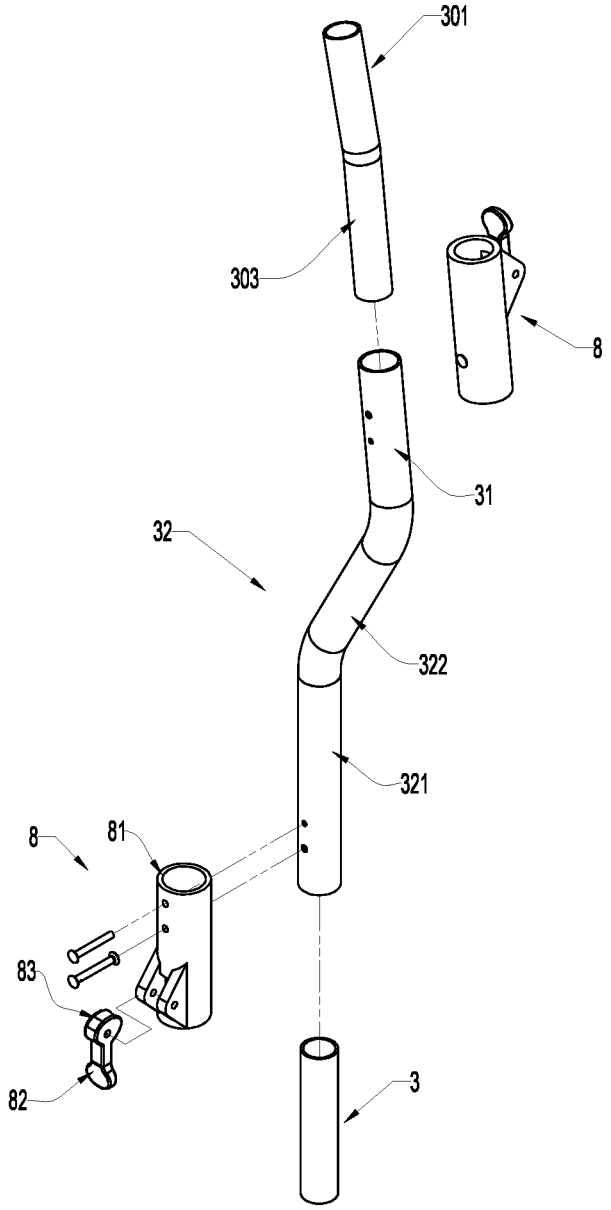
FIG. 8 shows a schematic diagram of the centering rod, shaft rod and sunshade pole relationship broken down into components.
Figure 9:
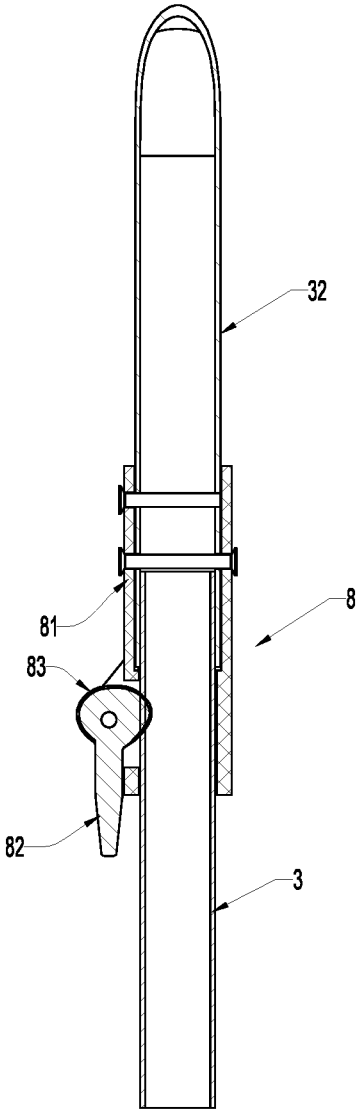
FIG. 9 shows a schematic diagram of the locking mechanism, shaft rode and centering rod relationship broken down into components.

As shown in FIGS. 6 and 8, the upper inclined section 31 on the shaft rod 3 is transferred to the centering rod 32 to maintain the straight structure of the shaft rod 3 and does not protrude after being folded, as shown in FIG. 7. More specifically, the centering rod 32 has a lower straight section 321, a curved section 322, and an upper inclined section 31. The upper inclined section 31 of the centering rod 32 and the lower inclined section 303 of the sunshade shaft form a connection. The lower straight section 321 is connected to the upper end of the shaft rod 3, making it equivalent to forming a centering rod from a shaft rod. A locking mechanism 8 is provided at the connecting position, and the orientation of the sunshade rod 301 can be adjusted by the locking mechanism at the lower straight section 321, that is, the orientation of the inclined sunshade surface. More specifically, there are two locking mechanisms 8, one is used to adjust the inclination angle of the sunshade surface, and the other is used to adjust the orientation of the sunshade surface. Each performs its own duty, and there is no need to adjust the position of the folding table to adjust the sunshade orientation.

Furthermore, the shaft rod 3 and the sunshade rod 301 have the same caliber and are smaller than the caliber of the centering rod 32. The ends of the shaft rod 3 and the sunshade rod 301 are inserted into the centering rod 32 when they are connected, and the locking mechanism 8 is locked on one side of the centering rod 32. After disassembly, the two locking mechanisms 8 and the centering rod 32 are short and easy to store. Furthermore, the lower straight section 321 and the upper inclined section 31 of the centering rod 32 can be designed to be rotationally symmetrical. Either end can be selected for assembly, which brings convenience to on-site installation.

Figure 10:
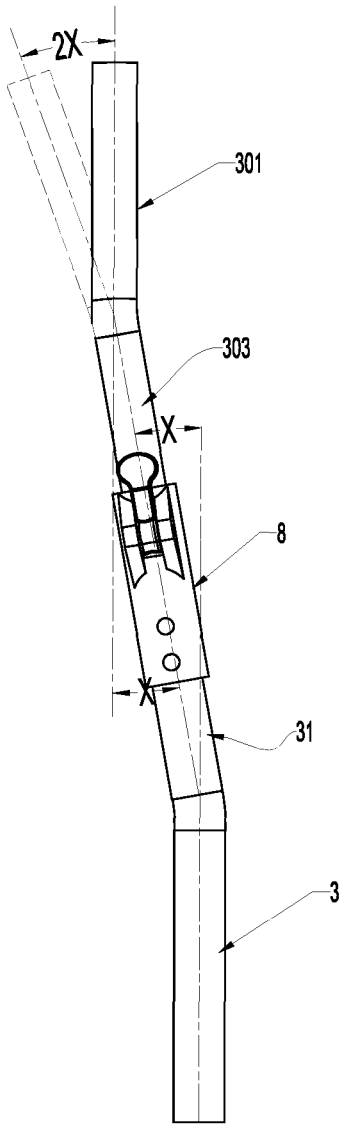
FIG. 10 shows a schematic diagram of the principle of adjusting the angle of the sunshade rod relative to the shaft rod.

Referring now to FIG. 10, the shaft rod 3 and the sunshade pole 301 have an upper inclined section 31 and a lower inclined section 303 with the same inclination angle. The angle X between the upper inclined section 31 and the centerline of the shaft rod 3 is equal to the angle between the lower inclined section 303 and the centerline of the sunshade pole 301. The lower inclined section 303 and the upper inclined section 31 are inserted to keep the center lines of the upper inclined section overlapped with the lower inclined section. The rotation of the lower inclined section 303 drives the sunshade pole 301 to rotate. The sunshade pole 301 will be adjusted in the range of upright to twice the included angle with the vertical line. The solid line in the figure shows that the sunshade pole 301 is in an upright state, and the dotted line indicates that the sunshade pole is at the limit angle of twice the included angle. With this structure, the inclination angle of the sunshade surface can be adjusted within this range. The upward inclined section 31 on the shaft rod points to the direction of the sunshade surface inclination. Pointing to the East blocks the sunlight from the East. For this reason, through the setting of a centering rod 32, an additional function of convenient adjustment of the orientation is achieved.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims. It is therefore to be understood that the present invention is not limited to the sole embodiment described above, but encompasses any and all embodiments within the scope of the following claims.

We claim:

1. A folding table, comprising:

a fabric tabletop (100) and a support section (200) supporting the tabletop;

the supporting section (200) includes an upper connecting plate (1), a lower connecting plate (2), a plurality of tabletop support rods (4), a plurality of connecting rods (5) and a shaft rod (3);

the tabletop support rods (4) are hinged at one end on the lower connecting plate (2), and the other end is used to support the tabletop (100);

one end of each of a corresponding number of connecting rods (5) is hinged on a one of the tabletop support rods (4), and an other end of the corresponding number of connecting rods is hinged on the upper connecting plate (1);

one end of the shaft rod (3) is locked on the lower connecting plate (2) or the upper connecting plate (1), an other end of the shaft rod (3) penetrates the upper connecting plate (1) or the lower connecting plate (2), and the upper connecting plate at the penetrating end (1) or the lower connecting plate (2) is provided with a locking kit (7), and a restraint relationship between the upper and lower connecting plates (1) and (2) is formed by the shaft rod (3), and the locking kit (7) form positioning;

the upper connecting plate (1) and the lower connecting plate (2) are arranged to move towards each other, and the tabletop support rod (4) is in an open state to support the tabletop;

further comprising a plurality of ground support rods (6) arranged to; pass through a slide bushing (41) positioned on the tabletop support rods (4), and an upper end of each of the ground support rods is hinged on the upper connecting plate (1) or a one of the plurality of connecting rods (5);

wherein when the tabletop support rod (4) is opened, the ground support rod (6) can slide along the slide bushing (41) and follow the slide bushing (41) to open outwardly, and a several of the ground support rods (6) are evenly distributed on a circumference centered on the shaft rod (3), supporting the whole structure.

2. A folding table according to claim 1, wherein:

there are three to six ground support rods (6), and a number of corresponding plurality of tabletop support rods (4) and the connecting rods (5) is the same as the number of ground support rods (6); and the upper end of the ground support rod (6) is hinged on a one of the plurality of connecting rod (5).

3. A folding table according to claim 1, wherein, the sunshade (300) has a sunshade pole (301), a sunshade frame (302) and a sunshade surface;

the sunshade frame (302) is supported by the sunshade pole (301), and the sunshade frame (302) is used to support an opening and closing of the sunshade surface;

in the support section (200) of the folding table, a lower end of the shaft rod (3) is locked to a lower connecting plate (2);

an upper end of the shaft rod (3) passes through the upper connecting plate (1), and an upper inclined section (31) is arranged at an upper end of the shaft rod (3), and the corresponding locking kit (7) is arranged on the upper connecting plate (1);

a lower end of the sunshade pole (301) of the sunshade is provided with a lower inclined section (303), and the angles between the lower inclined section (303) and the upper inclined section (31) and their respective center lines are equal;

the sunshade pole (301) and the shaft rod (3) are connected with the upper inclined section (31) and the lower inclined section (303), so that the sunshade pole (301) can be adjusted from upright to twice the angle of inclination; and a locking mechanism (8) is also provided at a joint of the sunshade pole (301) and the shaft rod (3) to lock the inclination angle of the sunshade pole (301).

4. A folding table with sunshade combination according to claim 3, wherein:

a caliber of the shaft rod (3) is larger than a caliber of the sunshade pole (301), and the shaft rod and the sunshade pole are connected by inserting the sunshade pole (301) into the shaft rod (3);

the locking mechanism (8) is locked on one side of the shaft rod (3);

the locking mechanism (8) includes a sheath (81) and a handle (82) with a cam part located on the sheath (81); and the sheath (81) is nested on a side of the shaft rod (3) with a large caliber, and a cam portion (83) of the handle can resist on the side of the sunshade pole (301) with a small caliber to form a locking structure between the two.

5. A folding table with sunshade combination according to claim 3, wherein:

the upper end of the shaft rod (3) is equipped with a centering rod (32), and the upper inclined section (31) is arranged on the centering rod (32);

the centering rod (32) has a lower straight section (321), a curved section (322), and the upper inclined section (31);

with the help the centering rod (32), the upper inclined section (31) is connected to the lower inclined section (303) of the sunshade pole (301), the lower straight section (321) is connected to an upper end of the shaft rod (3); and a locking mechanism (8) is provided at a connecting position, and an orientation of the sunshade pole (301) can be adjusted by means of the locking mechanism (8) at the lower straight section (321).

6. A folding table with sunshade combination according to claim 5, wherein:

the shaft rod (3) and the sunshade pole (301) have a substantially equal caliber, which caliber is smaller than a caliber of the centering rod (32);

whereby when connecting, the ends of the shaft rod (3) and sunshade pole (301) are inserted into the centering rod (32), and the locking mechanism (8) is locked on the side of the centering rod (32);

the locking mechanism (8) includes a sheath (81) and a handle (82) with a cam portion on the shaft positioned on the sheath (81);

the sheath (81) is nested on a side of the centering rod (32) with a large caliber; and the cam portion (83) of the handle can abut on a side of the sunshade pole (301) and the shaft rod (3) with a small caliber to form a locking structure between the sunshade pole and the shaft rod.

7. A folding table according to claim 3, wherein:

there are three to six ground support rods (6), and a number of corresponding tabletop support rods (4) and the connecting rods (5) is the same as the number of ground support rods (6); and the upper end of the ground support rod (6) is hinged on a one of the plurality of connecting rods (5).

* * * * *